US005898116A

United States Patent [19]

Lin

[11] Patent Number: 5,898,116

[45] Date of Patent: Apr. 27, 1999

[54] PLATE ASSEMBLY FOR WOODWINDS

[76] Inventor: Wei-Fu Lin, 3F, No. 8, Lane 118, Ming-Teh Rd., Pei-Tou, Taipei, Taiwan

[21] Appl. No.: 08/922,351

[22] Filed: Sep. 3, 1997

[51] Int. Cl.[6] ..... G10D 7/00; G10D 9/00

[52] U.S. Cl. ..... 84/380 R; 84/382; 84/384; 84/385 R; 84/385 A

[58] Field of Search ..... 84/380 R, 385 A, 84/382, 384, 385 R, 380 G, 381, 386

[56] References Cited

U.S. PATENT DOCUMENTS 2,744,435 5/1956 Anderson et al. ..... 84/380

*Primary Examiner*—William M. Shoop, Jr.
*Assistant Examiner*—Marlon T. Fletcher
*Attorney, Agent, or Firm*—Beveridge, DeGrandi, Weilacher & Young LLP

[57] ABSTRACT

An improved plate assembly of woodwinds comprising a body being longitudinally provided with a plurality of tone holes is provided. Each of the tone holes is provided with a pair of posts at both sides. A copper shaft is pivotally mounted within the posts. A plate which may cover the tone hole is pivotally mounted onto the copper shaft. The lower portion of one of the posts is disposed with a resilient pin. The copper shaft is disposed with a projected pin shaft and a depressing key rod. The resilient pin is disposed such that the projected pin shaft is biased. When the depressing key rod is depressed, the copper shaft is rotated and the tone hole can be opened or closed by the plate to generate a special tone. The upper portion of the post is provided with a ball socket and both ends of the copper shaft are provided with a mounting hole respectively. One of the mounting hole of the pipe is provided with a groove. The mounting hole is disposed with a coil spring and a biasing pin having a ball head which is movably disposed within the mounting hole. The biasing pin is provided with annular groove and the ball head of the biasing pin is pivotally received within the socket of the post. By this arrangement, as the pipe is movably and resiliently disposed between the posts, the pipe can be easily assembled to the posts. Consequently, the locking arrangement with screws can be suitably prevented. Furthermore, the noise is also completely eliminated.

1 Claim, 7 Drawing Sheets

PLATE ASSEMBLY FOR WOODWINDS

FIELD OF THE INVENTION

The present invention relates to a plate assembly, more particularly, to a plate assembly for woodwinds in which the pin shaft can be suitably and pivotally received within the shaft holes of two adjacent posts. As a result, the locking screw can be beneficially eliminated.

DESCRIPTION OF PRIOR ART

The woodwinds, such as the saxophone, clarinet, flute etc., are played by manipulating a plurality of keys which in turn open or close a corresponding holes. As a result, a single tone or a melody can be played.

In the existing woodwinds, the body (a) is longitudinally provided with a plurality of tone holes (a1). Each of the tone hole is provided with a pair of posts (b) at both sides. A pipe (c) is disposed between two posts. The pipe (c) is mounted with a plate (d) corresponding to a tone hole (a1). One of the posts (b) is provided with a resilient pin (e). The pipe (c) is mounted with a projected pin shaft (c1) and a depressing key shaft (c2). The resilient pin (e) is biased against the projected pin shaft (c1). As a result, when the depressing key rod (c2) is depressed, the pipe (c) is rotated and the plate (d) is covered onto the tone hole (a1) and a special tone is generated, as shown in FIG. 5.

The post (b) is provided with a threaded hole (b1) in which a pin screw (f) is locked. The pipe (c) is provided with a recess (c3) at both ends such that the sharp end of the pin screw (f) is received within the recess (c3) of the pipe (c). As a result, the pipe (c) can be disposed between those two posts (b), as shown in FIG. 6.

Since the pipe (c) is bridged onto the sharp ends of the pin screw (f), accordingly, those pin screws (f) shall be attached to the posts (b) before the mounting of the pipe (c). This is really laborious.

Because the pipe (c) is supported by the sharp ends of the pin shaft (f), the center of the pin screw (f) can not be aligned with the center of the pipe (c) in the very beginning. The operator shall rotate the pin screw (f) to get the accurate alignment. A noise may be simply generated because of the tightness of the pin screw (f), i.e. too slack or too tight. If the pin screw (f) is too tight, the pipe (c) will be locked and can not rotate. Accordingly, the mounting of the pipe (c) with the pin screw (f) shall be carefully performed and adjusted to get a proper operation of the pipe (c). As a result, the maintenance and repairing work are really laborious and cost much. Only a person skilled in the art can perform the maintenance and repairing work.

Apparently, there is a room to improve the mounting of the pipe (c) by means of the pin screws (f).

As shown in FIG. 7, a fastening device is disclosed. The pipe (c) is provided with a spring (g) and a hollow stick (h) therein. The pin screw (f) may screw into the threaded hole (b1) of the post (b) such that the sharp end of the pin screw (f) is inserted into the head portion of the hollow stick (h) and the pipe (c) is bridged between those two posts (b).

Even this arrangement may use the spring (g) to bias the hollow stick (h) to avoid the over-tightness between the pin screw (f) and the pipe (c), the assembling of these components are laborious and troublesome. On the other hand, the spring (g) and the hollow stick (h) are disposed within the pipe (c), i.e. the hollow stick (h) shall be firstly mounted within the recess (c3) of the pipe (c), then the pipe (c) can be bridged between those two posts (b) and fixedly positioned by screwing the pin screw (f) into the post (b). On the other hand, if the pipe (c) is not smoothly disposed between the posts (b) after the hollow stick (h) is disposed within the pipe (c), the hollow stick (h) may easily jump out.

Since there are a plurality of key sets on the woodwinds and each of the key sets is different from other with size and position, the assembling of the key sets are really laborious. Because, the mounting of the pipe (c) is laborious, this will make the assembling of the key sets more and more difficult. There is really room to improve it.

Besides the excellent tone being a key concern of making an excellent woodwinds, the aesthetic appearance is also a the main concern. However, in the conventional post (b), a threaded hole (b1) shall be drilled to provide a mounting for the pin screw (f). In light of this, the overall appearance of the woodwind is comparative cold as compared to the smoothness and beauty of the melody. As a result, the overall appearance is not matched with the tone.

In the conventional assembling of the key, the pipe (c) is bridged onto a pair of posts (b) by means of pin screw (f). However, it is not easy to adjust and a noise may readily be generated. As a result, the performance will be influenced.

SUMMARY OF THE INVENTION

It is the objective of this invention to provide an improved plate assembly in which the conventional problem can be completely solved.

It is still the objective of this invention to provide an improved plate assembly wherein it can be easily and conveniently assembled.

It is still the objective of this invention to provide a plate assembly wherein the noise between the pipe and the posts can be completely avoided.

In order to achieve the objectives set forth, the upper portion of the post is provided with a ball socket and both ends of the copper shaft are provided with a mounting holes respectively. One of the mounting hole of the pipe is provided with a groove. The mounting hole is disposed with a coil spring and a biasing pin having a ball head which is movably disposed within the mounting hole. The biasing pin is provided with an annular groove and the ball head of the biasing pin is pivotally received within the socket of the post. By this arrangement, as the pipe is movably and resiliently disposed between the posts, the pipe can be easily assembled to the posts. Consequently, the locking arrangement with screws can be suitably prevented. On the other hand, the ball head of the biasing pin is movably received within the socket of the post, the noise can be beneficially and completely eliminated. Besides, the movement of the ball head with respect to the socket can be also improved. Because no threaded hole be drilled onto the post, the overall appearance of the post is further improved.

It is still the objective of this invention to provide an improved plate for woodwinds wherein both ends of the pipe is disposed with a biasing pin having ball head thereof. The post is provided with a socket thereof. The pipe can be readily bridged onto the posts by the movable engagement between the ball head of the biasing pin and the socket of the post. Consequently, the screwing process can be eliminated and no noise will be generated.

It is still the objective of this invention to provide an improved plate assembly with which the overall appearance of the woodwinds can be increased since no threaded hole is required on the post.

BRIEF DESCRIPTION OF THE DRAWINGS

In order that the present invention may more readily be understood the following description is given, merely by way of example with reference to the accompanying drawings, in which.

BRIEF DESCRIPTION OF NUMERALS

Figure 1:
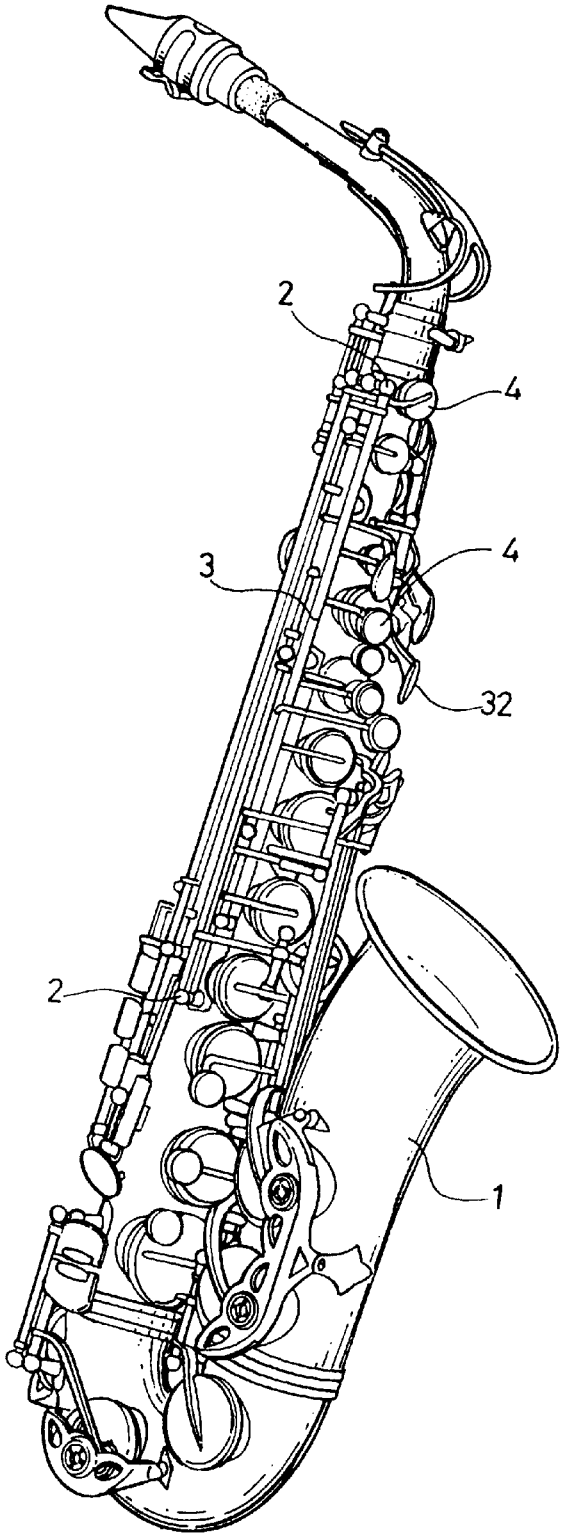
FIG. 1 is a perspective view of the improved plate assembly made according to the present invention.

1 body
2 post
3 pipe
32 depressing key rod
34 groove
36 biasing pin
362 annular groove
5 resilient pin
11 tone holes
21 socket
31 projected pin
33 mounting hole
35 coil spring
361 ball head
4 plate

DETAILED DESCRIPTION OF PREFERRED EMBODIMENT

Figure 2:
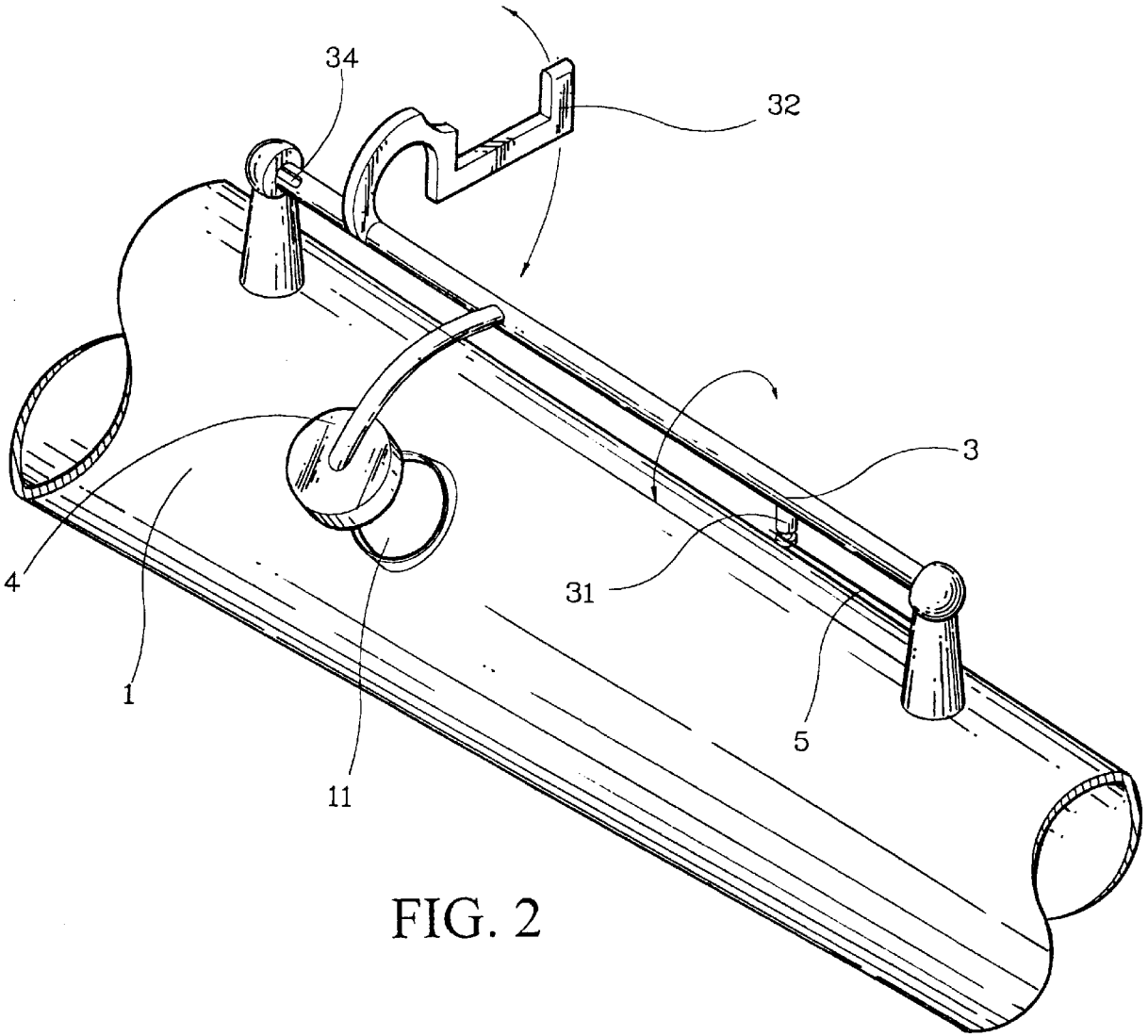
FIG. 2 is a partial, perspective view of the plate assembly made according to the present invention.

Referring to FIGS. 1 and 2, the body 1 is longitudinally provided with a plurality of tone holes 11 and each of the tone hole 11 is provided with a pair of posts 2 at both sides. A copper shaft 3 is pivotally mounted within the posts 2. A plate 4 which may cover the tone hole 11 is pivotally mounted onto the copper shaft 3. The lower portion of one of the posts 2 is disposed with a resilient pin 5. The copper shaft 3 is disposed with a projected pin shaft 31 and a depressing key rod 32. The resilient pin 5 is disposed such that the projected pin shaft 31 is biased. When the depressing key rod 32 is depressed, the copper shaft 3 is rotated and the tone hole 11 can be opened or closed by the plate 4. As a result, a special tone is generated.

Figure 3:
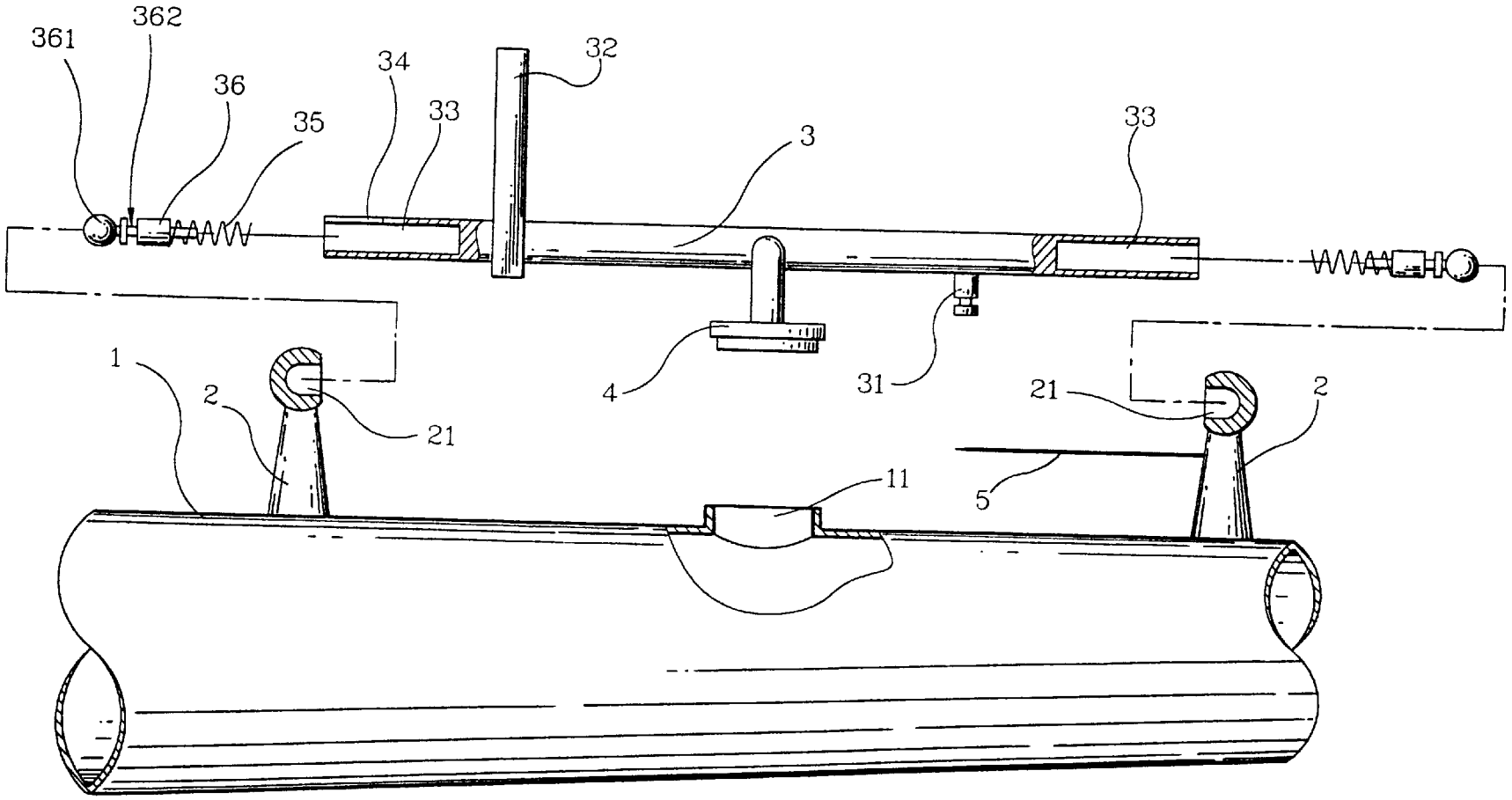
FIG. 3 is an exploded, partial and cross sectional view of the plate assembly made according to the present invention.

The upper portion of the post 2 is provided with a ball socket 21 and both ends of the copper shaft 3 are provided with a mounting hole 33 respectively. One of the mounting hole 33 of the pipe 3 is provided with a groove 34. The mounting hole 33 is disposed with a coil spring 35 and a biasing pin 36 having a ball head 361 is movably disposed within the mounting hole 33. The biasing pin 36 is provided with annular groove 362 and the ball head 361 of the biasing pin 36 is pivotally received within the socket 21 of the post 2, as shown in FIG. 3.

From the forgoing description, since the mounting holes 33 of the copper shaft 3 are movably disposed with coil spring 35 and the biasing pin 36, the ball head 361 of the biasing pin 36 can be movably received within the socket 21 of the post 2. By the provision of the biasing pin 36, the copper shaft 3 can be pivotally mounted between the posts 2 without the application of the locking screws. As a result, the assembling can be quickly and conveniently performed.

The pipe 3 is pivotally mounted between the posts 2 by the cooperation of the ball head 361 of the biasing pin 36 which is biased by a coil spring 35 and the socket 21 of the posts 2. Accordingly, the engagement between the ball head 361 and the socket 21 can be automatically adjusted without manually adjusting. The alignment and adjustment can be therefore eliminated.

Furthermore, the connection or engagement is attained by the ball head 361 and the socket 21 of the posts 2, accordingly, the ball head 361 can be automatically disposed within the center of the socket 21 of the posts 2. Accordingly, no noise will occur during the manipulation of the plate and key.

Figure 4:
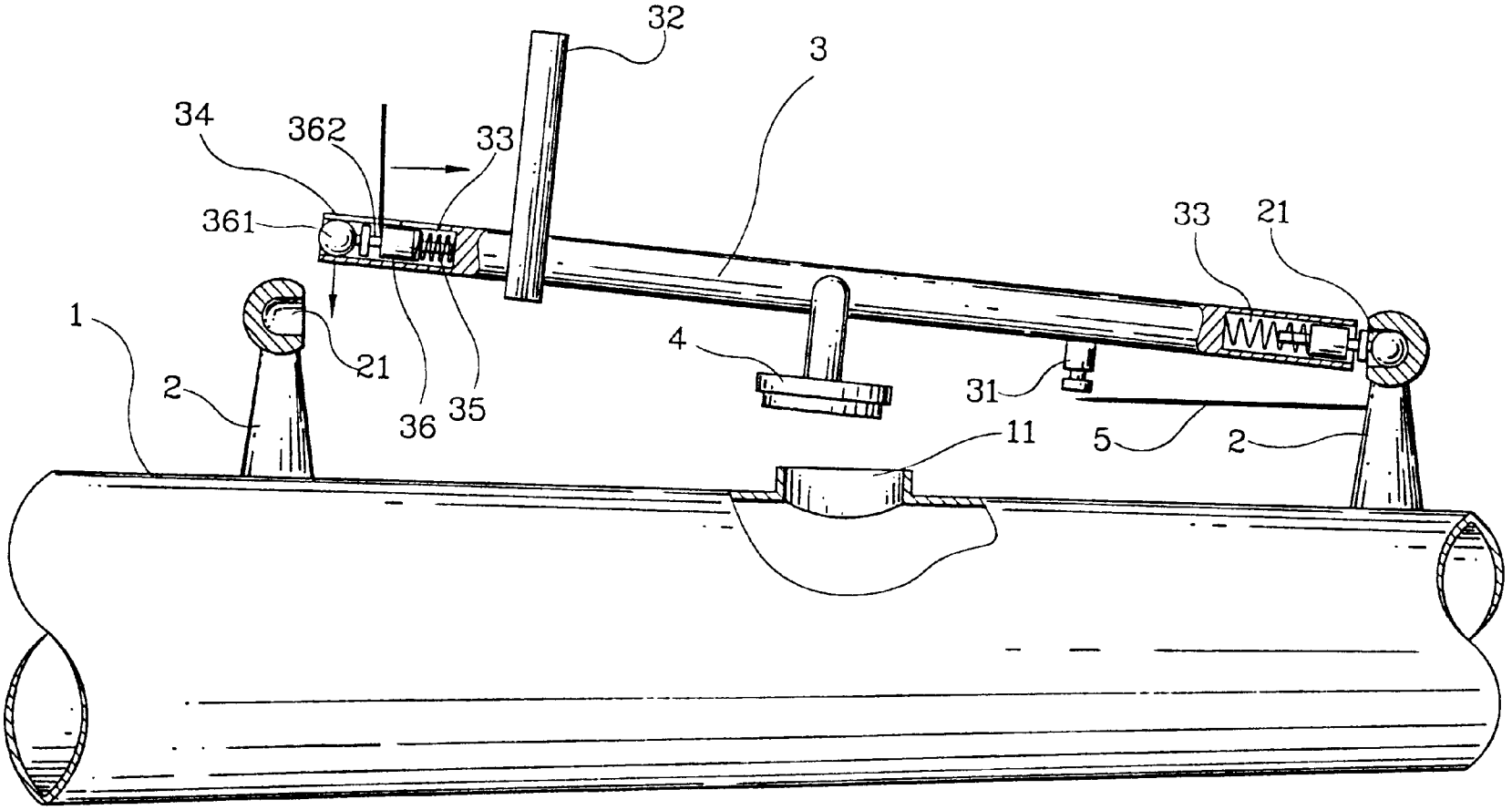
FIG. 4 is a cross sectional view of the plate assembly after assembled.
Figure 5:
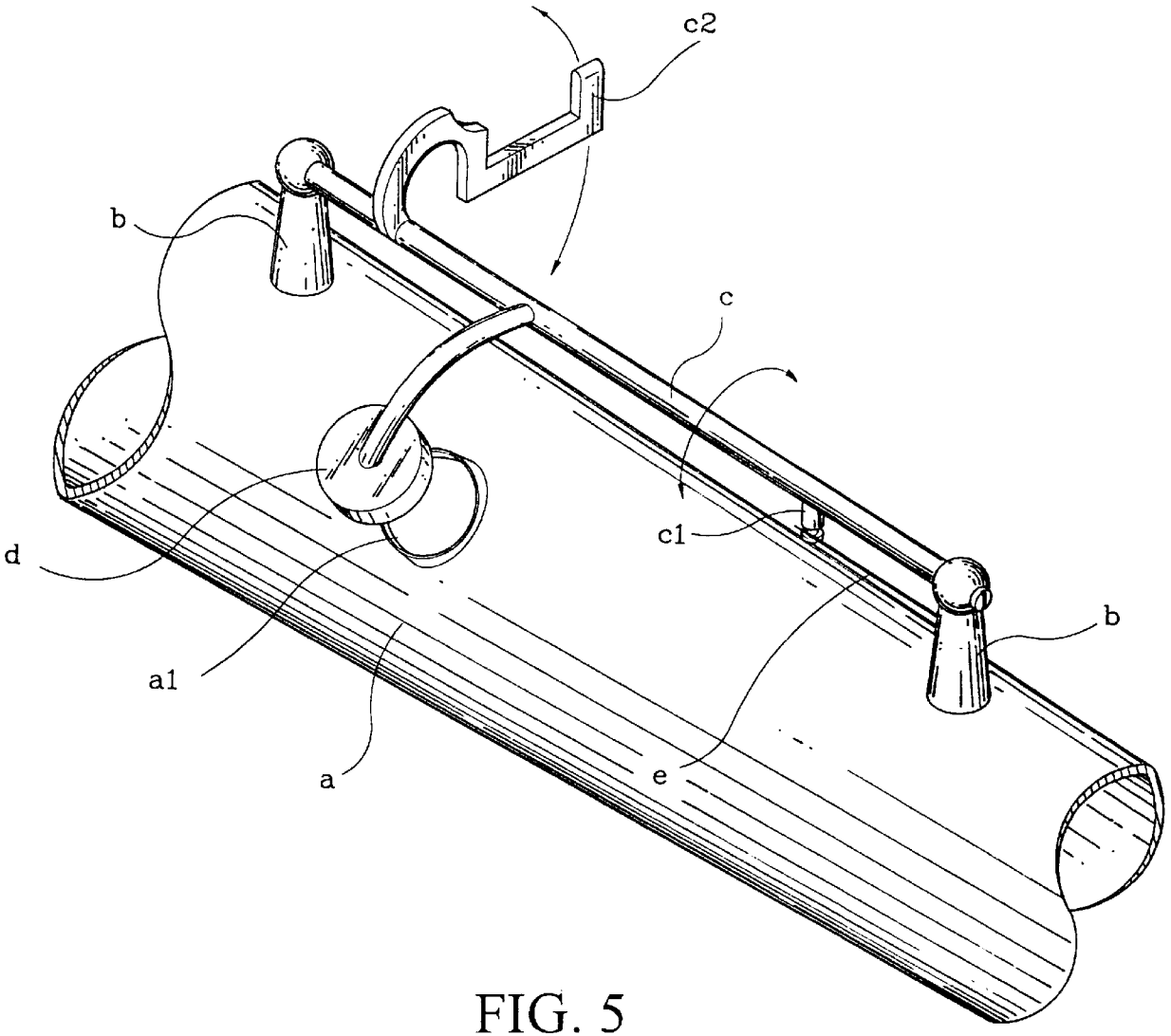
FIG. 5 is a partial, perspective view of the conventional plate assembly.
Figure 6:
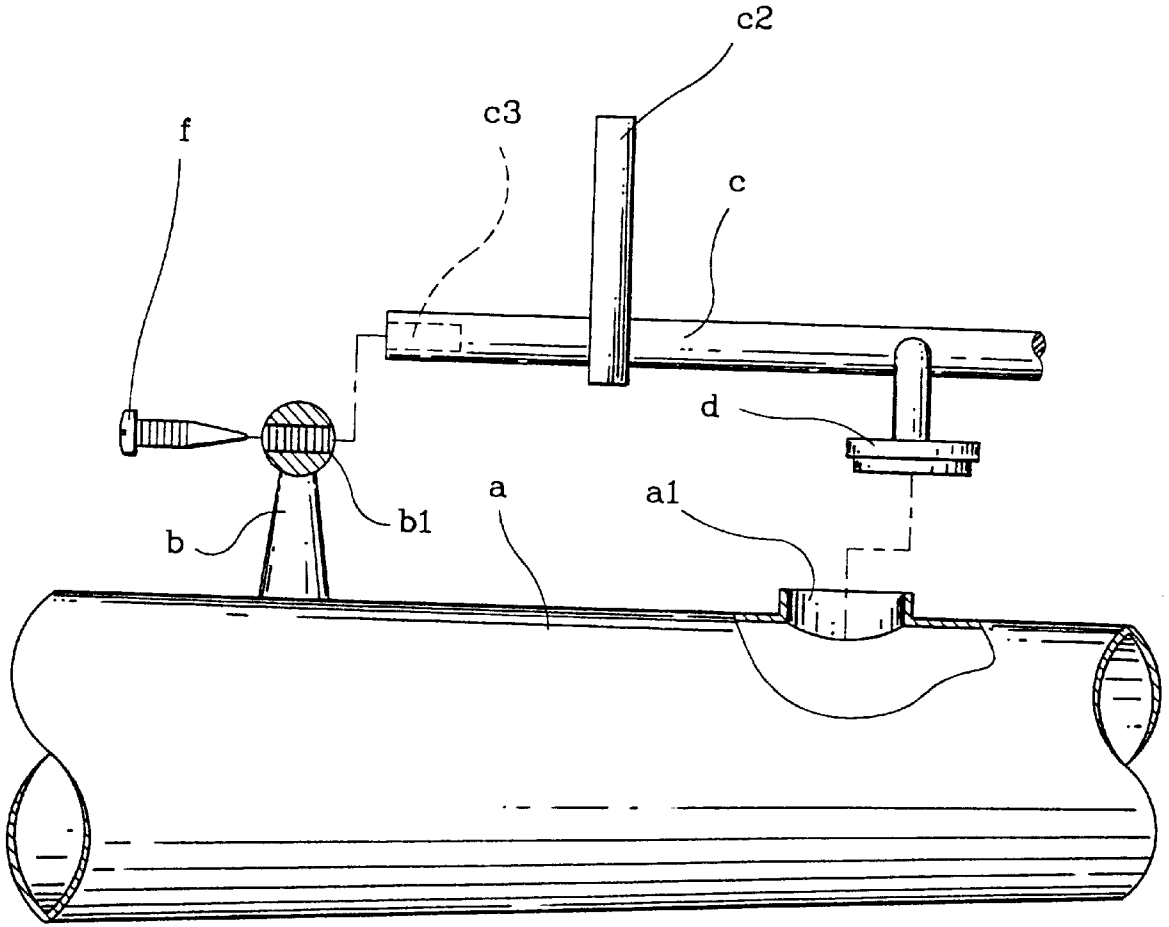
FIG. 6 is an exploded perspective view of the conventional plate assembly.
Figure 7:
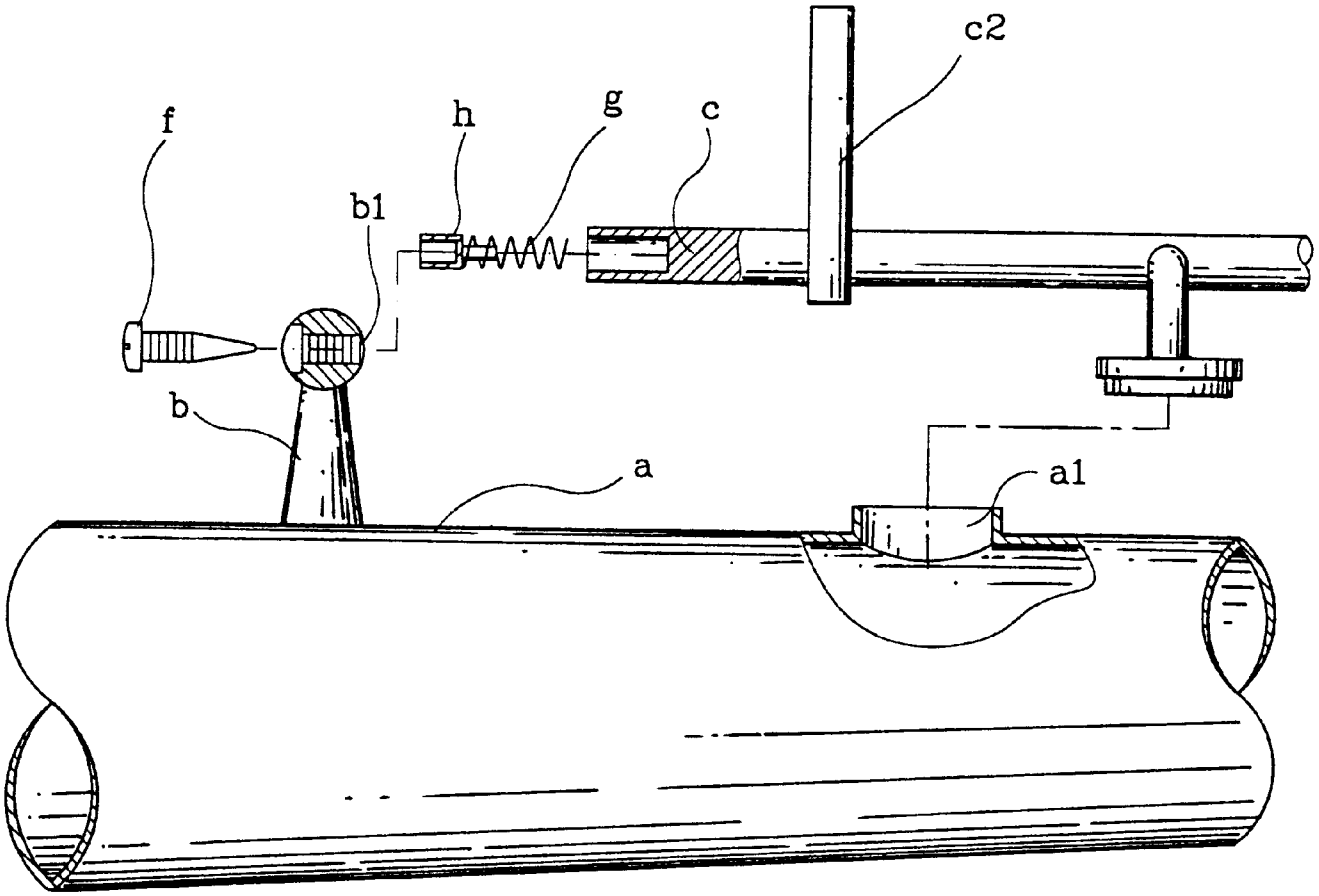
FIG. 7 is an exploded perspective view of another conventional plate assembly.

If the pipe 3 be remove for maintenance, a pin tooling can be used to access the annular groove 362 of the biasing pin 36 within the mounting hole 33 via the groove 34. The biasing pin 36 can be pushed inward such that the ball head 361 is released from the socket 21 of the post 2. Finally, the pipe 3 can be dismounted, as shown in FIG. 4. By this arrangement, both the mounting and dismounting of the pipe 3 can be conveniently and quickly done.

Since the posts 2 are not disposed in threaded holes, as a result, the posts 2 can be ensured with an aesthetic appearance.

While the particular embodiment of the present invention has been illustrated and described, it would be obvious to those skilled in the art that various other changes and modifications can be made without departing from the spirit and scope of the invention. It is therefore intended to cover in the appended claim all such changes and modifications that are within the scope of the present invention.

What is claimed is:

1. An improved plate assembly for woodwinds, comprising a body which is longitudinally provided with a plurality of tone holes, each of said tone hole being provided with a pair of posts at both sides, a copper shaft being pivotally mounted within saids posts, a plate which may cover the tone hole being pivotally mounted onto said copper shaft, the lower portion of one of said posts being disposed with a resilient pin, said copper shaft being disposed with a projected pin shaft and a depressing key rod, said resilient pin being disposed such that said projected pin shaft is biased, wherein when said depressing key rod is depressed, said copper shaft is rotated and said tone hole can be opened or closed by said plate to generate a special tone, characterized in that:

the upper portion of said post is provided with a ball socket and both ends of said copper shaft being provided with a mounting hole respectively, one of said mounting holes of said copper shaft being provided with a groove, said mounting hole being disposed with a coil spring and a biasing pin which has a ball head being movably disposed within said mounting hole, said biasing pin being provided with an annular groove and said ball head of said biasing pin being pivotally received within said socket of said post.

* * * * *